United States Patent [19]

Kratz et al.

[11] Patent Number: 4,636,363

[45] Date of Patent: Jan. 13, 1987

[54] APPARATUS AND METHOD FOR CONDITIONING RADIOACTIVE WASTES FOR ULTIMATE STORAGE

[75] Inventors: Gerhard Kratz, Rodgau; Siegfried Meininger, Offenbach; Eckhard Fischer, Ramstadt; Dietmar Bege, Erlangen, all of Fed. Rep. of Germany

[73] Assignee: Kraftwerk Union Aktiengesellschaft, Mülheim am Ruhr, Fed. Rep. of Germany

[21] Appl. No.: 558,797

[22] Filed: Dec. 7, 1983

[30] Foreign Application Priority Data

Dec. 8, 1982 [DE] Fed. Rep. of Germany ..... 3245443

[51] Int. Cl.[4] ..... G21F 9/04; G21F 9/16; G21F 9/20

[52] U.S. Cl. ..... 422/159; 252/628; 252/631; 252/633; 141/285

[58] Field of Search ..... 422/159, 224, 225; 250/506.1, 507.1; 252/626, 633, 631; 210/280; 141/285; 366/241, 242, 249, 261

[56] References Cited

U.S. PATENT DOCUMENTS

| | | | |
|---|---|---|---|
| 3,663,178 | 5/1972 | Miller et al. | 422/159 |
| 3,966,175 | 6/1976 | Stock et al. | 252/633 |
| 4,030,708 | 6/1977 | Stock et al. | 252/633 |
| 4,056,362 | 11/1977 | Gablin et al. | 252/631 |
| 4,196,169 | 4/1980 | Gablin et al. | 252/631 |
| 4,439,403 | 3/1984 | Brunner et al. | 422/159 |
| 4,460,499 | 7/1984 | Boden | 252/633 |

FOREIGN PATENT DOCUMENTS

| | | | |
|---|---|---|---|
| 2950403 | 6/1981 | Fed. Rep. of Germany | 252/633 |
| 3009005 | 8/1981 | Fed. Rep. of Germany . | |

OTHER PUBLICATIONS

Oyen, L. et al. 1979, Updating Radwaste Processing, Storage, Power, vol. 123 (10): 81–87.

*Primary Examiner*—Stephen J. Lechert, Jr.
*Assistant Examiner*—Howard J. Locker
*Attorney, Agent, or Firm*—Herbert L. Lerner; Laurence A. Greenberg

[57] ABSTRACT

Apparatus for the conditioning of radioactive wastes capable of ultimate storage, using a multicomponent binding agent, with a continuous-flow mixer, a filling station for the ultimate storage barrels, a receiver tank for liquid waste materials, a silo for a component of the binding agent, and several conveyors. A premixer for the one binding agent component and for flowable waste materials is provided. The premixer is connected via throughput measuring devices to the silo and to a container for flowable wastes. The premixer is connected via a dosing conveyor device to one end of the continuous-flow mixer. Thereafter, the receiver tank is connected to the continuous-flow mixer. A discharge conveyor device which feeds the ultimate storage barrels is mounted at the other end of the continuous-flow mixer.

6 Claims, 2 Drawing Figures

APPARATUS AND METHOD FOR CONDITIONING RADIOACTIVE WASTES FOR ULTIMATE STORAGE

BACKGROUND OF THE INVENTION

1. Field of the Invention

The invention relates to apparatus and method for conditioning radioactive wastes for ultimate storage, using a multicomponent binding agent, with a continuous-flow mixer, a filling station for the ultimate storage barrels, a receiving tank for liquid waste materials, a silo for component for the binding agent, and several conveyors.

2. Description of the Prior Art

Customarily, the multicomponent binding agents, particularly water-hardening cements, are mixed with the wastes in the ultimate storage barrels, for instance in the so-called standard drums of 200 liters volume. Usually, "lost" stirrers are used here as is described, for instance, in German Published Prosecuted Application DE-AS No. 3 009 005.

From the journal "Power", October 1979, pages 81–87, it is also known to take liquid wastes from a mixing tank via a feed pump to a mixing pump which is fed with cement from a cement silo. The mixing pump discharges into a filling station, in which sodium silicate is added by another conveyor pump. Everything is then transported into drums which are shipped to ultimate storage.

SUMMARY OF THE INVENTION

An object of the invention is to provide apparatus and method for conditioning different radioactive wastes into a small waste volume capable of ultimate storage. The installation known from the journal "Power" is not suitable for this purpose because it can process only liquid wastes. In addition, there is the danger that different liquid wastes may lead to different consistencies of the end product, which is a factor in whether the enclosure will safely contain the activity carriers. In the plant according to German Published Prosecuted Application DE-AS No. 3 009 005, mentioned at the outset, the equipment requirements are undesirably large. In this connection, the stirrer which gets lost in each barrel, should be mentioned.

With the foregoing and other objects in view, there is provided in accordance with the invention an apparatus for conditioning radioactive wastes with a multicomponent binding agent to form a wastes/binding agent mixture for ultimate storage comprising (a) a silo for one binding agent component of a multicomponent binding agent (b) a container for flowable wastes (c) a premixer in which the one binding agent component and the flowable wastes are mixed (d) conduit means including a throughput measuring device for introducing measured amounts of the one binding agent component into the intake side of the premixer (e) a second conduit means including a throughput measuring device for introducing measured amounts of the flowable wastes into the intake side of the premixer (f) a receiver tank for liquid waste materials (g) a continuous-flow mixer having a mixing device for mixing incoming liquid waste materials with the mixture of the one binding agent component and flowable wastes from the premixer, and a discharge conveyor device at the discharge end of the continuous-flow mixer for the discharge of the mixture therein (h) transfer means including a dosing conveyor device connecting the discharge side of the premixer with one end of the continuous-flow mixer for introducing measured amounts of the mixture in the premixer into the continuous-flow mixer (i) a third conduit means including a throughput measuring device for introducing measured amounts of the liquid waste materials from the receiver tank into the continuous-flow mixer for admixture with the mixture of the one binding agent component and flowable wastes from the premixer (j) a filling station having an ultimate storage container for the containment of the waste/binding agent mixture in the continuous-flow mixer, and (k) conduit means from the discharge end of the continuous-flow mixer to the filling station for passage of the waste/binding agent mixture to the ultimate storage container.

In accordance with the invention, there is provided a method for conditioning radioactive wastes with a multicomponent binding agent to form a wastes/binding agent mixture for ultimate storage which comprises introducing measured amounts of one binding agent of a multicomponent binding agent and measured amounts of flowable wastes into the inlet side of a premixer wherein they are mixed, introducing the mixture of the one binding agent and the flowable wastes discharged from the premixer into one end of a continuous-flow mixer containing a mixing device for mixing incoming materials and a discharge conveyor device at the other end of the continuous-flow mixer, introducing measured amounts of liquid waste materials into the continuous-flow mixer for admixture with the mixture of the one binding agent component and the flowable wastes from the premixer, passing the waste/binding agent mixture from the discharge end of the continuous-flow mixer to a filling station and filling an ultimate storage container at the filling station with the waste/-binding agent mixture.

Other features which are considered as characteristic for the invention are set forth in the appended claims. Although the invention is illustrated and described herein as embodied in an apparatus and method for conditioning radioactive wastes for ultimate storage, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings in which.

DETAILED DESCRIPTION OF THE INVENTION

Figure 1:
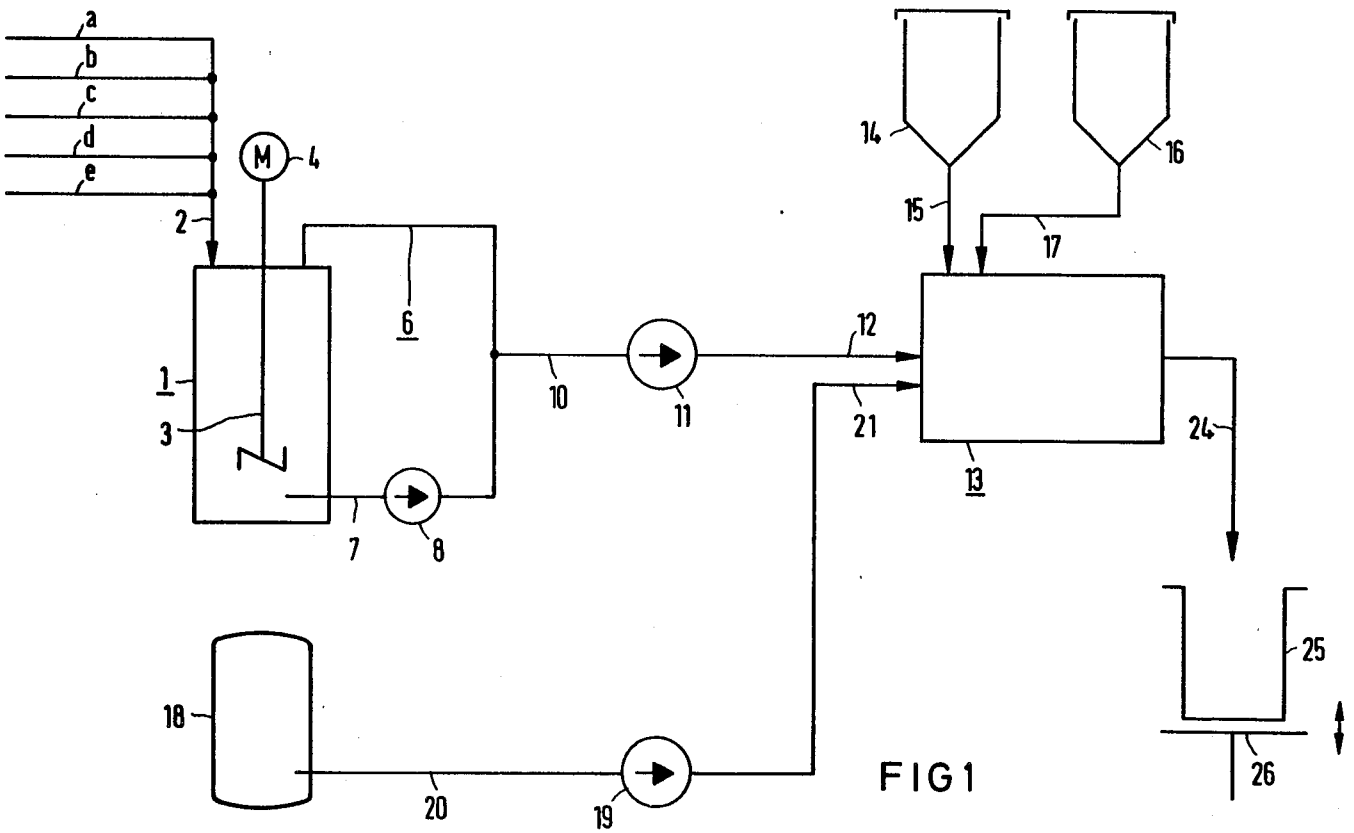
FIG. 1 diagrammatically illustrates apparatus and shows in simplified form carrying out of the method of conditioning radioactive wastes in accordance with the invention.

According to the invention, a premixer is provided for one binding agent component and for flowable waste materials. The premixer is fed through throughput-measuring devices connected to a silo containing the one binding agent component and to a tank for flowable wastes. The premixer for discharge of the mixture of the one binding agent component and flowable wastes is connected via a dosing conveyor to one end of a continuous mixer. A receiver tank containing liquid wastes is connected to feed such liquid wastes into the continous-flow mixer. At the other end of the continuous-flow mixer, a discharge conveyor is arranged which feeds the ultimate-storage barrels.

The premixer treats dry waste materials, in particular dried spherical or powdered resins, activated carbon, for instance, in granular form, and also ashes which stem from the combustion of activity-loaded textiles, papers, etc. The waste materials can be homogenized in the premixer and mixed with the one binding agent component. Optionally, additives which are essential for the setting of the binding agent can also be added there, for instance, the sodium silicate fed into the filling station, according to the journal "Power". The premixer may also be employed for feeding-in additives which, in the form of sand, gravel or the like ensure the strength or freedom from cracks of the end product.

The premixer is followed by the continuous-flow mixer, in which liquid wastes are continuously mixed under control with a water-hardening binding agent. If only dry wastes are to be conditioned so that they can be taken to ultimate storage, another component of the binding agent can be added in this continuous-flow mixer which other component is water when cement is the binding agent. In addition, dry wastes can also be mixed in the continuous-flow mixer with liquid wastes in one operation. The liquid wastes provide the binding water for the other binding agent component premixed with the solid wastes.

The apparatus with its discharge conveyor, in accordance with the invention, permits not only filling the conditioned wastes into lower-situated ultimate storage barrels but also pouring in the conditioned wastes from the bottom of the barrel to obtain a rising level. Thereby, with the apparatus of the invention waste materials in the form of filter cartridges or the like can be cast-in and enclosed by the binding agent.

The continuous-flow mixer preferably has a vertical throughput direction with the premixer being connected to the upper end. The premixer, however, may have a horizontal throughput direction. The connection of the receiving tank to the continuous-flow mixer is underneath the horizontal premixer, which latter is of a length to obtain a sufficiently long mixing section.

A connection for adding lubricants can advantageously be arranged in the input side of the discharge conveyor. Such lubricants may be, for instance, lubricating oils of reactor coolant pumps which accumulate in large quantities. It is important that the components of the binding agent, particularly water and cement, are already mixed before the lubricants are added, otherwise the lubricants could interfere with the mixing of the binding agent components.

The discharge conveyor is preferably designed for steady throughput and variable pressure. This requires little energy if barrels are filled from the top. On the other hand, however, as already mentioned, pouring in the rising mode can be accomplished even where a counterpressure is produced by the rising filling levels.

The outlet of the continuous-flow mixer is advantageously connected to the line connecting the receiver tank with the continuous-flow mixer, via a back-flushing line which can be shut off. Thereby, intensive cleaning of the part of the apparatus provided for wet mixing can be achieved at low cost.

Such back-flushing is particularly advantageous, however, if plastics are used as binding agents. For example, after the components of the binding agent are mixed and would set in due course, flushing with the monomers of the one component plastics can be performed before clogging of the continuous-flow mixer occurs due to hardening of the plastics. The cleaning mixture can then optionally be collected and used for the setting of the next charge.

In one proven embodiment of the invention, the moving parts of the continuous-flow mixer subjected to wear have a length of less than 700 mm and a width of 500 mm. This design has the result that the parts subject to wear can be accommodated without further processing in standard ultimate storage barrels, the so-called standard drums of 200 liters volume. Also other parts subject to wear, for instance those of the premixer, can advantageously be similarly designed.

The product volume of the continuous-flow mixer is advantageously less than 5 liters. This means that the activity (radioactivity) volume is limited. Nevertheless, large throughput volumes can be obtained with the apparatus, of the order of 1 $m^3/h$ or more. A "slim" design of the continuous-flow mixer is advisable here so that the diameter is less than 200 mm because this is important with regard to radiation pollution of the environment.

The mechanical design of the apparatus can be in the form of a stationary plant, but may also be movable by means of a chassis. In any case, a collecting tray is advisable with which the premixer, the continuous-flow mixer and conveyors as well as silos and tanks are provided in order to collect drops or splashes of activity carrying wastes. At least for the premixer, a control of the air, oscillating because of the varying content of wastes etc, should be provided by venting and exhaust stubs. This vented air can then be fed to a ventilating system.

To explain the invention in greater detail, an embodiment example will be described in the following which is shown, simplified, in FIGS. 1 and 2.

The apparatus includes a receiver tank 1 for liquid wastes. The receiver tank has a volume of, for instance, 1 $m^3$. It may be made in the form of a steel tank with austenitic lining and is charged, as indicated by arrow 2, with different liquids. Among them are (a) water which may be active (radioactive) or inactive,
(b) liquid concentrate from evaporators or the like,
(c) suspensions of active substances suspended in water,
(d) spent resin from ion exchanger filters with the liquid required for flushing,
(e) other aqueous wastes.

The above mentioned liquids are set in motion in the tank 1 by a stirrer 3 which is operated by a drive motor 4. In any event, thorough mixing is to be achieved in the supply tank 1 which results in chemical and physical values suitable for the ultimate storage and interaction with the binding agent. Among them is the pH value, which should be neutral as far as possible, a limited solids content of about 20%, and the maximum activity which is given by the processing and the ultimate storage regulations.

The maintenance of the desired consistency is additionally aided by a homogenizing loop 6. It comprises a suction line 7 which leads to a pump 8 at the underside of the receiver tank 1. The output line of the pump ends at the top side of the receiver tank 1.

From the homogenizing loop 6, a spur line 10 with a dosing pump 11 leads through line 12 to a continuous-flow mixer 13. The continuous-flow mixer 13 is designed similar to continuously operating cement mixers known from the construction industry. However, in the invention, it has several different feed possibilities for different wastes. The binding agent is taken to be cement in the following.

The water required for the setting of the binding agent is fed-in into continuous-flow mixer 13 through line 12 which comes from the dosing pump 11. A silo 14 with a volumetric capacity of 250 liters contains the cement, preferably Portland cement, as the water-hardening binding agent. The cement is transported through line 15 to the continuous-flow mixer 13.

A similar supply tank 16 contains available flowable dry materials for processing in the mixing device 13. Included among the flowable dry materials are powders and granulates with radioactive contamination, for instance, activated carbon filters from exhaust systems, dried powdered resins from ion exchangers or the like, and also ashes from burned radioactive wastes. The flowable dry materials are fed into the continuous-flow mixer 13 via a line 17.

Tank 18 which may have a volume, for instance, of 500 liters contains spent oil. The term "spent oil" includes lubricants of any kind as long as its consistency is suitable for being conveyed by a dosing pump 19 which withdraws the spent oil through line 20 from the container 18 and forces it through line 21 into the continuous-flow mixer 13.

The output of the continuous-flow mixer 13 passes to a waste drum 25 which is arranged on a vibrating table 26. Devices for moving empty drums into a position to be filled and for transporting filled drums away are not shown.

Figure 2:
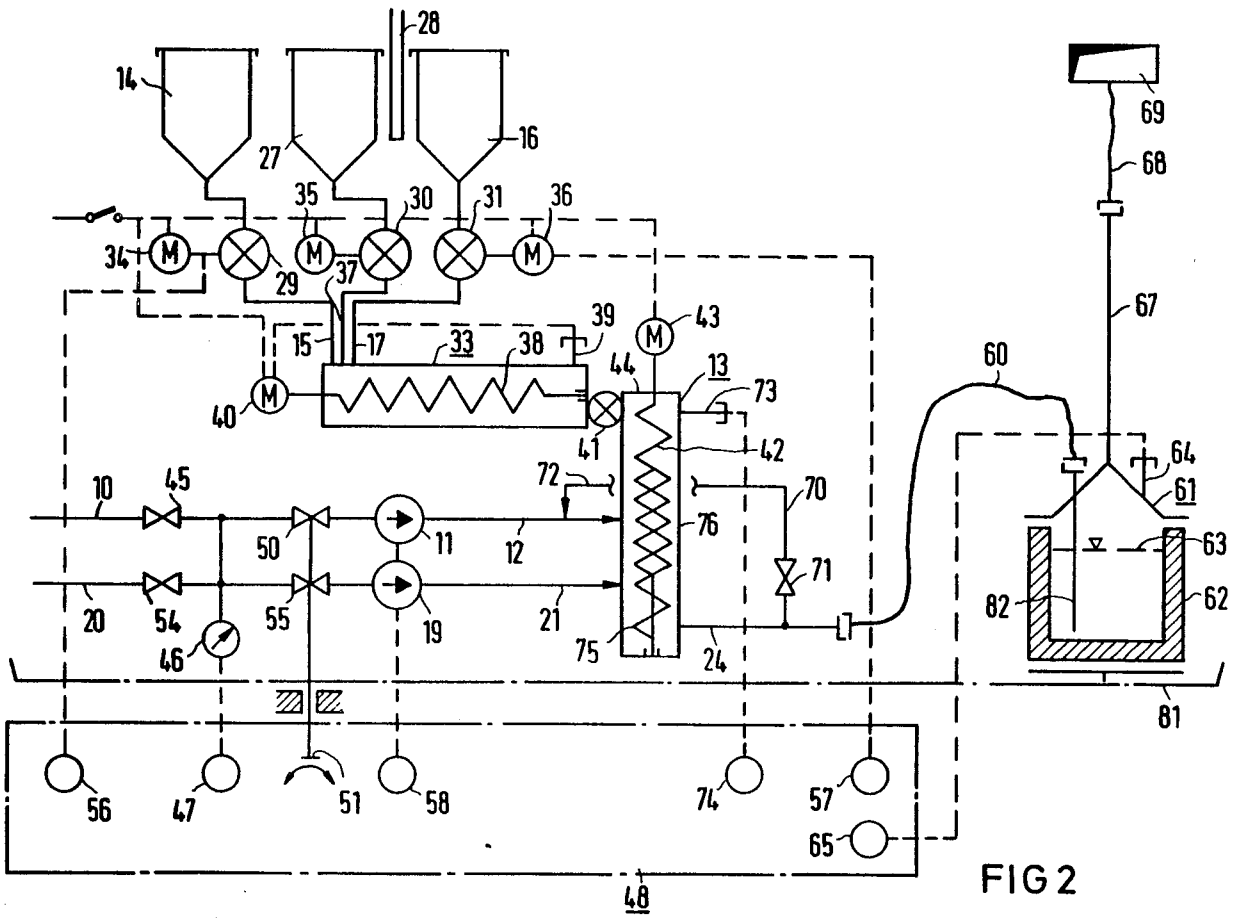
FIG. 2 shows in greater detail the structure and relationship of the various units, particularly the premixer and continuous-flow mixer as well as the hook-up between these mixers and the containers from which feed material is fed to the mixers.

From FIG. 2, which shows further details of the invention, it will be noted that in addition to the silo 14 with a volume of, for instance, 250 liters of inactive cement, a tank 27 for inactive additives to the cement is provided, which additives when added improves the setting process. Opposite the tank 16 also with a silo capacity of 250 liters, a separation is indicated by a wall 28 to shield the active wastes of the container 16 in the form of waste powder, carbon, ash or the like from the inactive binding agent.

The silo 14 and the containers 16 and 27 are connected via dosing devices 29, 30, 31 in the form of bucket wheel locks to a premixer 33 which serves to homogenize the dry components of the mixture to be sent to ultimate storage. The bucket wheel locks 29, 30, 31 which are driven by electric motors 34, 34, 36 control the desired content of the components of the mixture.

The output lines 15, 17 and 37 from the respective silo 14 for cement, supply tank 16 for flowable dry materials and silo 27 for inactive additives, lead to one end of the premixer 33. The latter has a screw 38 which is actuated there by a drive motor 40 which is controlled through line 39 dependent on the throughput. Thereby, a dry mixture is obtained with the dry throughput moving in a horizontal direction. The premixed dry material is then transferred from premixer 33 by conveyor 41 to the continuous-flow mixer 13 proper.

As shown in FIG. 2, the continuous-flow mixer 13 has a stirring device 42 which is driven by an electric motor 43. Stirrer 42 is in a cylindrical housing 76, has a vertical axis and a diameter of 150 mm. The lower part 75 of the stirring device acts as a conveyor screw by means of which the mixed material is discharged continuously with a steady throughput of, for instance, 1.5 $m^3/h$ and at a pressure determined by the resistance of the line 24. The continuous-flow mixer 13 is the so-called wet mixer. From its upper end 44 on the input side, at which the conveyor 41 is provided, to the end on the output side, continuous flow mixer 13, has a product volume of less than 5 liters. As a consequence of this small volume, the activity inventory in flow mixer 13 is limited and taken together with the slender shape of housing 76, this leads to low radiation.

The line 12 from the dosing pump 11 opens into flow mixer 13 at a point which is located in the upper third of the stirrer 42. The line 10 from the receiver tank 1 for liquid wastes, not shown in detail in FIG. 2, is connected via a shutoff valve 45 to a pressure measuring line which has a pressure gage 46, which pressure can also be read at 47 at a control console 48. Further along line 10, but ahead of the dosing pump 11 is a valve 50 which can be operated from the console 48 as is indicated by a handle 51. The pressure measurement is important for setting and maintaining the amount of liquid. Optionally, a pressure reducer for limiting the water pressure to 2 bars can be provided.

Beneath the line 12 is line 21 which opens into the continuous-flow mixer 13 for feeding-in spent oil. The dosing pump 19 forces measured amounts of spent oil through line 21 into flow mixer 13. The point of entry of line 21 is immediately above the conveyor screw 75 in order that the spent oil is taken into the "finished" mixture. The line 20 to the container 18, not shown in detail (FIG. 1), is equipped with a valve 54 and is likewise provided with a pressure-measuring device as well as with a valve 55 which can be operated from the control console 48.

The control console 48 has an indicator 56 from a flow meter which is associated with the bucket wheel lock 29, so that the supply of cement can be controlled continuously. Another indicator 57 is associated with the bucket wheel lock 31 to indicate the quantity of the dry waste (solid waste) fed to the premixer 33. A further indicator 58 shows the amounts of aqueous wastes, for instance spent oil, which get into the continuous-flow mixer 13, in order that the consistency of the waste mixture may be set to a constant value.

The discharge line 24 of the continuous-flow mixer 13 leads via a flexible line 60 to a hood 61 which can be placed on the shielding container 62 serving as the ultimate storage barrel. The binding agent/waste mixture is filled up to a level 63, the height of which is monitored via a connection 64 to a filling level measuring device. The indicator 65 at the control console 48 shows the instantaneous filling level. It may be connected to an automatic device for shutting-down the continuous-flow mixer 13.

The conical hood 61 has at its highest point an exhaust line 67 with a flexible hose 68 for connection to a suction line 69. A corresponding venting arrangement may also be advisable for the premixer 33. The latter can be provided with a closed housing. The pressure in the interior of the housing can be adjusted in accordance with air pressure fluctuations.

Inactive water, which can be fed-in by the dosing pump 11 through line 10, is used for cleaning the continuous-flow mixer 13. The cleaning action can be intensified by a flushing loop which begins in the line 24 with valve 71, continues with line 70 and returns to the line 12, as indicated by the arrow 72. The flushing can also be performed with an increased liquid level. To monitor the latter, a filling level measuring device is provided which is connected to the continuous-flow mixing plant at 73. The level indication is shown at 74 in the control console 48.

A tray 81 indicated by dash-dotted lines in FIG. 2, collects radioactive drops and splashes. The tray 81 may also be used as the base structure for the entire device. It may be provided with wheels so that a mobile device is obtained.

In the embodiment example according to FIG. 2, the conveyor screw 75 is structurally combined with the stirring device 42. However, this may also be a seaparate pump for viscous material. This applies particularly to the case in which larger solid wastes are to be cast-over by a rising waste mixture in the shielding container 62. Among such larger wastes are the parts of the continuous-flow mixer 13 which are subjected to wear. Thus, the stirring device 42 with its length of 600 mm and the conveyor screw 75 with its length of 400 mm can in view of their small diameter of 120 mm be deposited without difficulty in a standard drum and be cast-over with cement paste or a cement/waste mixture in the rising mode, i.e. from a pipe 82 which leads to the bottom of the container 62.

Thus, for the purpose of conditioning different radioactive wastes for ultimate storage, a continuous-flow mixer 13 is used which is operated continuously and is charged with cement from a premixer 33 and optionally, with flowable dry waste and from a receiver tank 1 in which the liquid wastes are adjusted chemically. The filling into ultimate storage barrels 62 is accomplished by a filling line 24 which has a hood-like end piece 61 for placing it on the ultimate storage barrels 25 and comprises an immersion tube 82 in order to cast-in large pieces of waste in the rising mode.

The foregoing is a description corresponding, in substance, to German application No. P 32 45 443.0, dated Dec. 8, 1982, international priority of which is being claimed for the instant application, and which is hereby made part of this application. Any material discrepancies between the foregoing specification and the specification of the aforementioned corresponding German application are to be resolved in favor of the latter.

We claim:

1. Installation for conditioning radioactive wastes with a binding agent to form a wastes/binding agent mixture for ultimate storage comprising, a premixer in which a binding agent and flowable wastes are mixed, a tank for the flowable wastes connected through a throughput measuring device to the premixer, a silo for the binding agent connected through a throughput measuring device to the premixer, a receiver main tank for liquid wastes connected to a throughput measuring device to a throughput-mixer downstream from the entrance of the premixer mixture into the throughput-mixer, for mixing the liquid wastes with the mixture containing the binding agent discharged from the premixer, a discharge transport downstream from the throughput-mixer for filling barrels with conditioned radioactive wastes from the throughput-mixer for ultimate storage; the combination therewith of (a) said throughput-mixer having a vertical throughput direction, (b) said premixer arranged at the upper end of the throughput-mixer and provided with a movable member, and that (c) movable parts of the throughput-mixer which are subject to wear are less than 700 mm long and less than 500 mm wide.

2. Installation according to claim 1, wherein the volumetric capacity of the throughput-mixer is less than 5 liters.

3. Installation according to claim 1, wherein the diameter of the throughput-mixer is less than 200 mm.

4. Installation according to claim 2, wherein the diameter of the throughput-mixer is less than 200 mm.

5. Installation according to claim 1, including a port at the input side of the discharge transport for the introduction of spent lubricants.

6. Installation according to claim 5, wherein the discharge transport is constructed for continuous throughput, and variable pressure.

* * * * *